US010815596B2

(12) United States Patent
De Luca et al.

(10) Patent No.: US 10,815,596 B2
(45) Date of Patent: Oct. 27, 2020

(54) METHOD FOR OPERATING A LAUNDRY TREATMENT APPLIANCE AND LAUNDRY TREATMENT APPLIANCE

(71) Applicant: Electrolux Appliances Aktiebolag, Stockholm (SE)

(72) Inventors: Fernando De Luca, Porcia (IT); Andrea Mazzon, Porcia (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 76 days.

(21) Appl. No.: 16/307,243

(22) PCT Filed: May 24, 2017

(86) PCT No.: PCT/EP2017/062671
§ 371 (c)(1),
(2) Date: Dec. 5, 2018

(87) PCT Pub. No.: WO2017/215897
PCT Pub. Date: Dec. 21, 2017

(65) Prior Publication Data

US 2019/0292706 A1 Sep. 26, 2019

(30) Foreign Application Priority Data

Jun. 13, 2016 (EP) ..... 16174130

(51) Int. Cl.
*D06F 25/00* (2006.01)
*D06F 33/00* (2020.01)
(Continued)

(52) U.S. Cl.
CPC ..... *D06F 33/00* (2013.01); *D06F 25/00* (2013.01); *D06F 34/18* (2020.02); *D06F 58/02* (2013.01);
(Continued)

(58) Field of Classification Search
CPC ..... D06F 25/00; D06F 33/00; D06F 34/18; D06F 58/02; D06F 58/30; D06F 58/50;
(Continued)

(56) References Cited

U.S. PATENT DOCUMENTS

2013/0312202 A1 11/2013 Balinski et al.

FOREIGN PATENT DOCUMENTS

CN 101886319 A 11/2010
GB 2247250 A 2/1992
(Continued)

OTHER PUBLICATIONS

International Search Report and Written Opinion for International Application No. PCT/EP2017/062671, dated Jul. 17, 2017-11 pages.

*Primary Examiner* — Levon J Shaninian
(74) *Attorney, Agent, or Firm* — RatnerPrestia

(57) ABSTRACT

A method for operating a laundry treatment appliance having a casing within which a drum rotated by a motor is arranged, an opening provided in the casing for loading the laundry into the drum and a door adapted to open or to close the opening. The method includes performing a treatment cycle that includes: a) determining the amount of laundry load in the drum; and b) if the determined amount of laundry is outside a laundry load threshold range, issuing a warning to the user and waiting for a prescribed waiting time before starting the cycle, whereby during the waiting time the laundry treatment appliance switches to an operating mode in which the user to is allowed to change the amount of laundry load in the drum.

15 Claims, 6 Drawing Sheets

(51) Int. Cl.

| | |
|---|---|
| ***D06F 34/18*** | (2020.01) |
| ***D06F 58/02*** | (2006.01) |
| ***D06F 58/30*** | (2020.01) |
| ***D06F 58/50*** | (2020.01) |
| *D06F 103/02* | (2020.01) |

(52) U.S. Cl.
CPC ..... *D06F 58/30* (2020.02); *D06F 58/50* (2020.02); *D06F 2103/02* (2020.02); *D06F 2202/10* (2013.01); *D06F 2202/12* (2013.01); *D06F 2212/02* (2013.01); *D06F 2212/06* (2013.01); *D06F 2216/00* (2013.01); *D06F 2220/00* (2013.01)

(58) Field of Classification Search
CPC ..... D06F 2103/02; D06F 2202/10; D06F 2202/12; D06F 2212/02; D06F 2212/06; D06F 2216/00; D06F 2220/00
USPC ..... 8/137, 158, 159; 68/12.01, 12.04, 12.06, 68/23.1, 24, 131
See application file for complete search history.

(56) References Cited

FOREIGN PATENT DOCUMENTS

| | | |
|---|---|---|
| GB | 2269395 A | 2/1994 |
| WO | 0171085 A1 | 9/2001 |

METHOD FOR OPERATING A LAUNDRY TREATMENT APPLIANCE AND LAUNDRY TREATMENT APPLIANCE

FIELD OF THE INVENTION

The present invention concerns the field of laundry treating techniques. In particular, the present invention refers to a method for operating a laundry treatment appliance.

BACKGROUND ART

Nowadays the use of laundry treatment machines, both "simple" laundry washing machines (i.e. laundry washing machines which can only wash and rinse laundry) and laundry washing-drying machines (i.e. laundry washing machines which can also dry laundry), or drying machines (i.e. drying machines which can dry laundry) is widespread.

In the present description the term "laundry treatment appliance" will refer to simple laundry washing machines, laundry washing-drying machines or drying machines. Laundry treatment appliances such as washing or washing drying machines generally comprise an external casing provided with a washing tub which contains a rotatable perforated drum where the laundry is placed. A loading/unloading door ensures access to the drum. Laundry treatment appliances typically comprise a water supply unit and a products supply unit, preferably a drawer, for the introduction of water and washing/rinsing products (i.e. detergent, softener, rinse conditioner, etc.) into the tub. Known laundry treatment appliances are also provided with water draining devices that may operate during different phases of the washing program to drain the dirty water.

According to the known art, a complete treating program typically includes different phases during which the laundry to be washed is subjected to adequate treatments. A treating cycle usually comprises a main washing phase during which the laundry is treated by means of water and a detergent. The water is typically heated to a predetermined temperature based on the washing program selected by the user. It is also possible that hot water is introduced into the tub from the hot water mains. During the main washing phase the drum is rotated, so as to apply also a mechanical cleaning action on the laundry. At the end of the main washing phase the drum is typically rotated at high rotational speed, so in such a way that dirty washing liquid (i.e. water mixed with detergent) is extracted from the laundry, and this dirty washing liquid is drained to the outside by the water draining devices.

A successive step of the cycle typically comprises a rinsing phase which usually comprises one or more rinsing cycles/steps. In a rinsing cycle, clean rinse water may be first added to the laundry. The rinse water is absorbed by the laundry and the rinse water removes from the laundry detergent and/or dirty water not previously removed by washing liquid in the main washing cycle. The drum is then rotated to extract water and dirty water/detergent from the laundry: the dirty water extracted is drained from the tub to the outside by the water draining devices.

After a rinsing phase, one or more final spinning phases may be provided for the extraction of the residual water contained in the wet laundry. The water extracted during the spinning phase is drained towards the outside by means of the water draining devices (during or after the spinning phase).

Laundry dryers are household appliances built for drying clothes and comprise a drying chamber or drum into which the clothes to be dried are introduced. The drying chamber is rotatable supported within a cabinet and made to rotate by means of a driving motor, typically consisting of an electric motor connected to the drying chamber via a belt.

In a combined washer/dryer, the drying chamber usually is the drum, and one or more drying phases are added which typically commence after the rinsing phases. The drying phase usually involves rotation of the drum and applying hot air to the laundry.

The quality of the washing and/or drying process depends on several factors. One important factor is the amount of laundry loaded into the drum. If the drum is overloaded, the various laundry pieces can not perform a tumbling motion and their mutual contact can prevent detergent to homogeneously reach all surfaces; on the other hand, if the drum has a low amount of laundry with respect to the ideal amount for the selected cycle, several problems can occur, such as foam formation, loss of energy for a small amount of laundry, etc.

The document WO 01/71085 A1 describes a method for performing a wash cycle in a laundry treatment appliance. At the end of the wash cycle the machine notifies the user that an overloaded condition of the machine has occurred.

SUMMARY OF THE INVENTION

The aim of the invention is to provide a method for operating a laundry treatment appliance which optimizes the quality of the laundry treatment process.

It is a further aim of the invention to provide a laundry treatment appliance which performs an optimized laundry treatment process.

The invention therefor in a first aspect relates to a method for operating a laundry treatment appliance, comprising a casing within which a drum rotated by a motor is arranged, an opening provided in the casing for loading the laundry into the drum and a door adapted to open or to close said opening, whereby the appliance performs least one laundry treatment cycle, the laundry treatment cycle comprising the steps of:

a) determining the amount of laundry load in the drum;

b) if the determined amount of laundry is outside a laundry load threshold range, issuing a warning to the user and waiting for a prescribed waiting time before starting the cycle, whereby during said waiting time the laundry treatment appliance switches to an operating mode in which the user to is allowed to change the amount of laundry load in the drum.

Preferred embodiments of the invention are described in relation to the dependent claims and the description of the enclosed drawings.

The invention is based on the consideration that the performance of a laundry treatment appliance can be improved if the amount of laundry is adequately chosen. The effectiveness of a laundry treatment cycle depends on the ratios of water, detergent and laundry in the tub, the freedom of laundry to move in the drum and other factors. These factors can depend on the specific laundry treatment cycle chosen. Especially an overload of the laundry can prevent the laundry from getting in contact with water and detergent in a homogenous way. In the case of a drying operation, an overload can prevent hot air to reach all surfaces of the laundry in a homogeneous way. The user, however, usually typically does not precisely know the optimal amount of laundry that should be loaded and tends to wash as many items as possible at once, which will overload the machine.

Applicant has found that an overloading of laundry into the drum or a small amount of laundry with respect to those ideal for the selected program and performing the treatment cycle with this overload/not ideal condition can be prevented by communicating to the user an overload condition and to allow the user to change the amount of laundry essentially before the laundry treatment phases in which the laundry is treated by water and/or air is being started.

The laundry treatment cycle is preferably started by introducing or charging water into the tub. The waiting interval or start of the waiting time during which the appliance allows the user to access the drum starts preferably when the warning issued to the user. The waiting time ends before water is charged into the tub.

Preferably, the method comprises the steps of c) determining if the amount of loaded laundry has been changed after said warning has been issued;

d) if the amount of laundry load in the drum has not changed, starting the at least one laundry treatment cycle;

e) if the amount of laundry load has changed, re-performing steps a) to e).

With these additional steps, another possibility is given to the user to change the amount of loaded laundry if after the previous change the amount in the drum is still too large or too different from the ideal amount. If no change in the laundry has been performed, it can be assumed that the user would like to continue with the amount of laundry present in the drum, thus the laundry treatment process can start.

The laundry treatment process which is performed comprises at least one parameter which is related to the operation of at least one phase of this process, for example, the number of phases, spinning speed or duration, heating temperature, amount of water introduced into the tub, etc. Preferably, at least one parameter is adjusted as a consequence of the adjusted laundry load. In this way, the treatment process can be distinctively optimized to accommodate for the special amount of detected laundry load.

When the laundry load in the drum is mentioned, this expression refers to the load detected by the machine.

Preferably, the treatment cycle further comprises the step of indicating if and/or how much the amount of laundry load lies outside the laundry load threshold range. Especially if it is indicated how much the current load lies outside the prescribed range, in this way it is made convenient for the user to estimate how large the correction of the laundry load should be.

The warning preferably involves an acoustic signal and/or message. An acoustic signal allows the user to immediately recognize the overload/not ideal condition of laundry in the drum.

Preferably, the laundry treatment appliance comprises a display, whereby the warning preferably comprises displaying an indication on this display. This indication can be displayed alternatively or in combination with the acoustic warning.

Preferably, the warning is indicated on a dedicated area of the display. By displaying the warning, a sustainable effect is generated which allows the user to notify the overload/not ideal condition. This is also important if the user has not recognized the acoustic indication. The display of the warning on a dedicated area makes it convenient for the user to find or notice the warning.

In a preferred embodiment, on the display, it is signaled that laundry can be changed. This can be done, for example, by a symbol which pictographically shows that a possibility for the change or adjustment of laundry is given. It could also be given a message "Please remove/change laundry from/in the drum". In a preferred embodiment, it is also shown to the user that a time window has opened during which she or he can adjust the amount of laundry loaded in the drum. A countdown can be displayed, for instance counting down from a larger number of seconds to zero which indicates the time left available for starting the process of changing the amount of laundry.

The waiting amount of time is preferably between 10 and 120 seconds.

The waiting amount of time most preferably is 30 seconds.

Preferably step a) is performed without supplying water to said tub in an appliance which comprises a tub, especially a washer or combined washer/dryer.

Preferably, step a) is performed before supplying water to the tub. The determination of the amount of laundry is therefore performed in a dry state of the laundry. In this way, uncertainties related to the amount of water introduced into the tub have not to be considered.

Advantageously, in step a) the laundry load amount is determined by rotating the drum and measuring parameters related to the motor such as motor torque and/or motor current. Additionally or alternatively thereto, the amount of laundry can be determined by a weight sensor which measures the weight of laundry. If a weight sensor is used, the estimation of laundry load can be performed at least partially during the phases in which laundry is loaded or removed from the drum or during washing cycle or during a preliminary phase.

In a preferred embodiment, the laundry treatment appliance is a washing machine, a dryer or a combined washer/dryer.

Advantageously, step d) comprises supplying water to the tub. The washing operations are then started after water is charged into the tub.

The laundry load threshold range preferably depends on a selected washing program of said appliance and/or kind or type of laundry.

A changing of the amount of laundry load by the user is preferably detected by an opened door. Preferably, a changing of the amount of laundry is detected by an opening of the door and a subsequent closing of the door, during the waiting time.

In a preferred embodiment, the laundry treatment appliance is a combined washer/dryer, whereby the laundry treatment cycle is a combined washing and drying cycle, and whereby the laundry load threshold value of step b) is a threshold value based on the maximum laundry load that can be dried in the combined washing and drying cycle.

Preferably, in the combined washing and drying cycle, the drying operations are performed after all washing operations, especially after at least the last phase of said washing operations.

In a second aspect, the invention relates to a laundry treatment appliance, comprising a casing within which a rotatable drum rotated by a motor is arranged, an opening provided in the casing for loading the laundry into the drum and a door adapted to open or to close the opening, whereby the appliance is configured to perform at least one laundry treatment cycle, further comprising a control unit which is configured to conduct a method described above.

In a preferred embodiment, the laundry treatment appliance is built as front-loading washing machine or combined washer/dryer or dryer.

Preferably a user interface is provided on the appliance, whereby the user interface comprises a display. A user interface preferably provides a dedicated region on the appliance for interacting with the appliance and obtaining feedback from the appliance. The user therefore will expect notifications, warnings and indications on the user interface. The probability that the user will recognize the indication is therefore improved if it is shown on a user interface. The user interface is preferably arranged on the front side of the appliance, most preferably on a front panel.

The advantages of the invention are especially as follows. The method according to the invention improves the quality of the treatment of laundry by allowing to optimize the amount of laundry in the drum, thereby preventing insufficient/not ideal or inhomogeneous contact of detergent with the laundry or, in the case of a drying cycle, insufficient/not ideal or inhomogeneous contact with hot air. By determining again the amount of laundry after it has changed, it is possible to further optimize the loaded amount. The issuing of a warning allows the user to take action and change the amount of laundry accordingly.

BRIEF DESCRIPTION OF THE DRAWINGS

Further features and advantages of the present invention shall become clearer from the following detailed description of some of its preferred embodiments, made with reference to the attached schematic drawings and given as an indication and not for limiting purposes.

In particular, the attached drawings are included to provide a further understanding of the invention and are incorporated in and constitute a part of this specification. The drawings together with the description explain the principles of the invention. In the drawings, corresponding characteristics and/or components are identified by the same reference numbers. In these drawings:

In FIGS. 1-3, a laundry treatment appliance 2 is shown which is built as a front-loading washing machine and comprises housing or casing 6 with a preferable parallelepiped shape, the casing 6 comprising a front wall 10, two side walls 14, a cover plate 20 and a rear wall (not shown). Front wall 10 and side walls 14 are preferably part of a cabinet. A front door 24 is provided which can be opened for loading or unloading laundry through an opening 28 into a washing drum and which can be closed. Door 24 can be preferably operated, especially opened and closed, by a handle 26.

Figure 1:
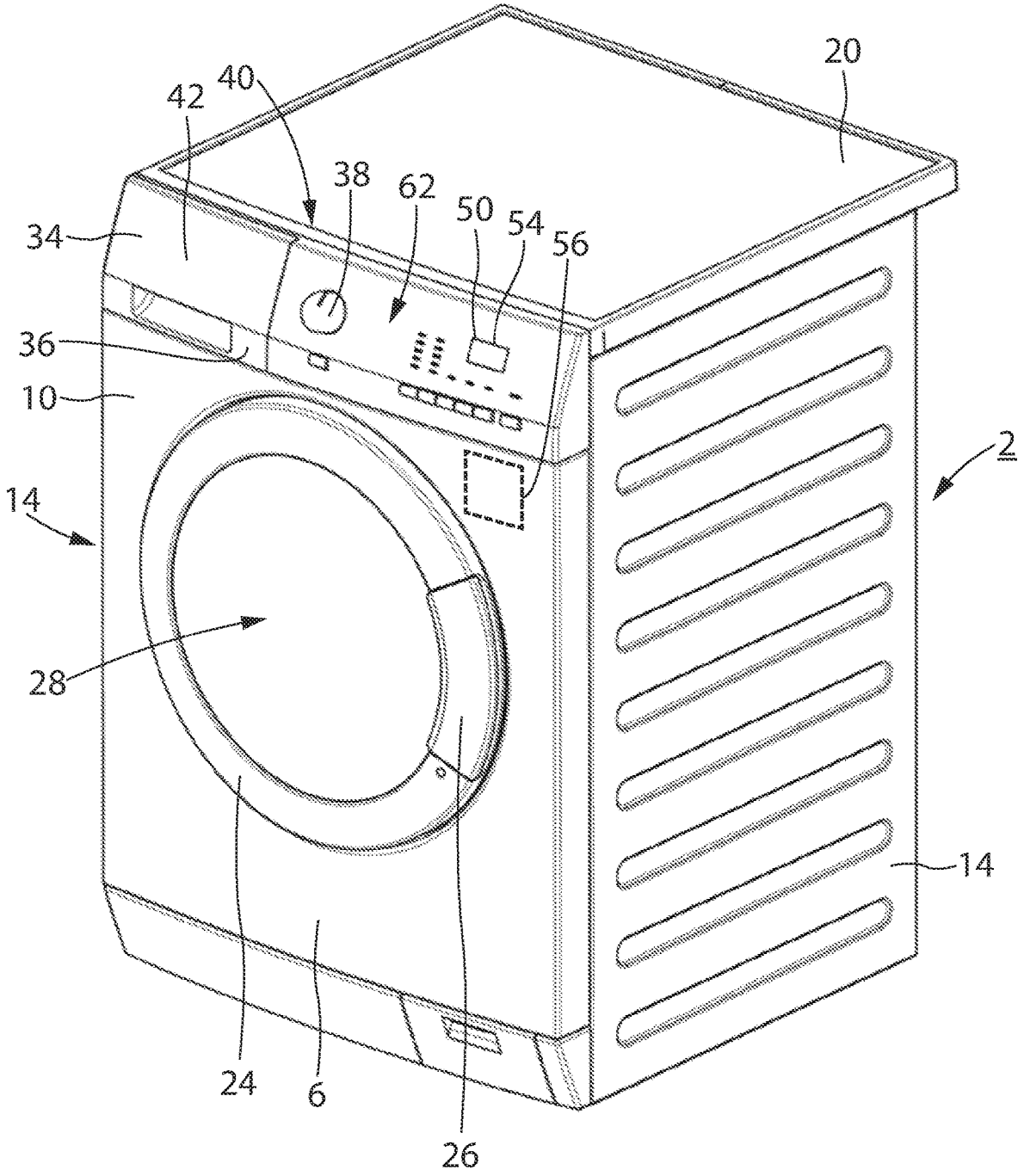
FIG. 1 shows a front loading washing machine in a preferred embodiment.

Advantageously a washing tub 30 is contained within casing 6, whereby a rotatable and perforated drum 36 is contained by the washing tub 30. Both washing tub 30 and drum 36 have a substantially cylindrical shape. Advantageously the tub 30 is suspended in a floating manner inside casing 6 by means of a number of coil springs 44 and shock absorbers 46. The drum 36 is rotated by an electric motor 68, which transmits the rotating motion of a motor shaft to the drum by a belt/pulley system 70. In a different embodiment of the invention, the motor can be directly associated with the shaft of the drum. The tub 30 is preferable connected to casing 6 by means of an elastic bellows 52 or gasket. Tub 30 preferably comprises two complementary hemi-shells 64, 66 structured for being reciprocally coupled to form tub 30.

Alternatively, the laundry appliance can be a combined washer and dryer or a dryer, in latter case the tub is not provided.

The preferred washing machine shown in FIG. 1 on a front panel 40 comprises a drawer 42 with a front plate 34 and a handle 36 for pulling out and pushing back in drawer 42. Drawer 42 comprises at least one compartment for detergent or washing additives. Adjacent to drawer 42, preferably a rotatable or rotary knob 38 is arranged for selecting a laundry treatment program and/or at least one parameter of a laundry treatment program. Preferably, knob 38 has also a push-functionality and can be pressed for selected and/or confirmation of selected options. Knob 38 is provided on a user interface 62 which can provide further indicating and/or control elements (not shown). Knob 38 is preferably arranged on front panel 40 adjacent to drawer 42.

On front panel 40, a display 50 is arranged on user interface 62. Display 50 comprises a dedicated area 54. A control unit 56 is indicated schematically which is configured to conduct a method which will be described below.

Figure 4:
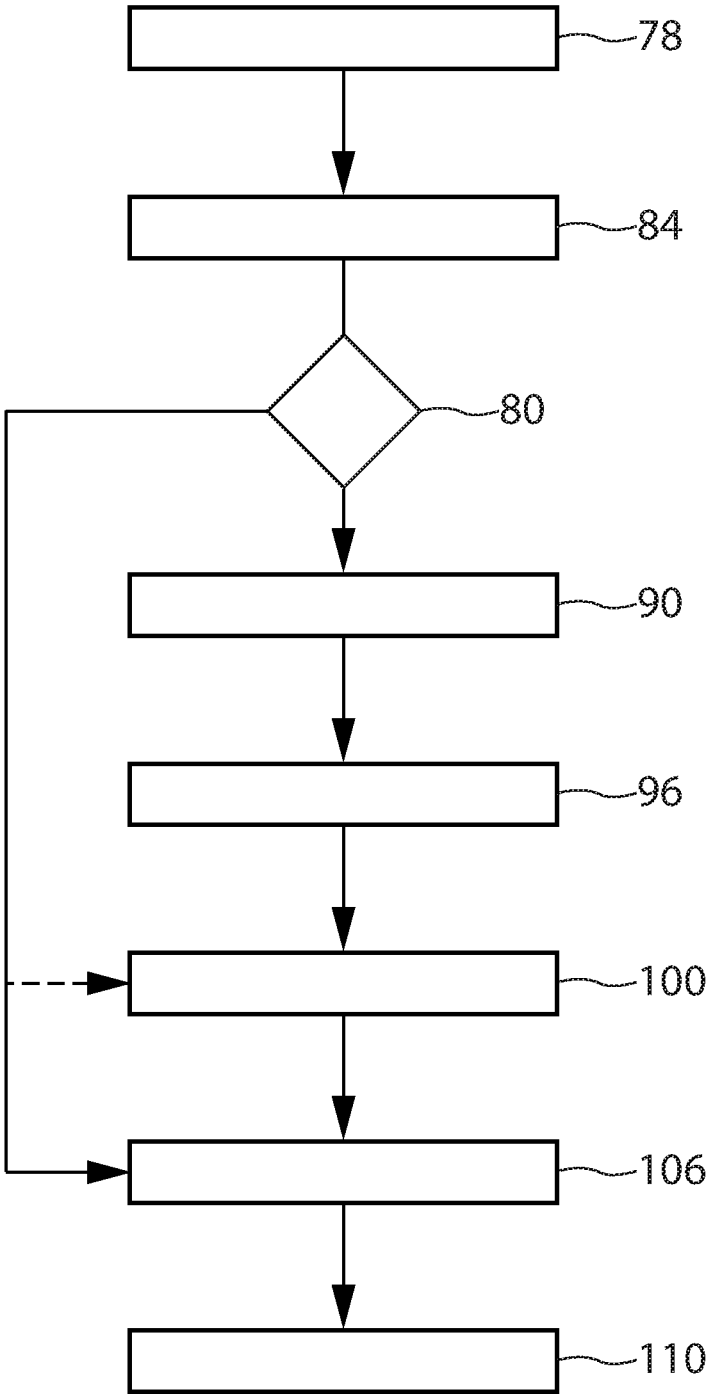
FIG. 4 shows a flow chart of a method for operating a laundry treatment appliance in a first preferred embodiment.

In FIG. 4, a method according to the invention in a first preferred embodiment is shown as a flow chart. In a first step 78, laundry is loaded into the drum through opening 28. After door 24 has been closed and a user interaction with the machine has happened, preferably pressing a start button on user interface 62, in a step 84 the amount of laundry in the drum is being detected. The opening and closing of door 24 are preferably detected by a door sensor. The detection of the amount of laundry is preferably performed by rotating the drum by the motor and measuring parameters related to the motor such as current, angular velocity, motor torque. In combination or alternatively, the amount of loaded laundry can be determined by means of a weight sensor.

In a decision 80, if the detected weight falls on the laundry load threshold range, the step 100 or the step 106 below described is preferably directly performed.

In the preferred/optional step 90, it is indicated to the user, preferably on dedicated area 54 of display 50, if the detected amount of laundry/is outside a laundry load threshold range. The laundry load threshold range has an upper bound and a lower bound. By choosing the lower bound as zero, the condition is equal to the condition that a threshold value, which corresponds to the upper bound, is not exceeded. This is especially useful if the appliance only checks an overload condition and not an underload condition.

This indication can be performed in a variety of ways. For instance, a red symbol can occur on area 54 if the detected laundry amount does not lie within the threshold range. If the detected amount lies within the threshold range, in a first variant, no visual indication is made at all. In a second variant, a green visual indication is made which shows the user that the detected amount of laundry does not lie within the threshold range. The threshold range is preferably chosen in such a way that a laundry amount below its lower bound is not optimal and that a laundry amount exceeding its upper bound is not optimal, whereby the condition "not optimal" refers to criteria such as, for instance, the resulting treatment effectiveness or energy consumption.

In a step 96, a warning is issued, preferably on the display 50. In addition or alternatively, also an acoustic signal/alarm can be issued, which can draw the attention of the user to the appliance 2 and especially to the display 50. Preferably, the warning comprises a message that the amount of loaded laundry should be changed, which can be indicated by a symbol and/or by a text message.

In a step 100, the laundry treatment appliance waits for a prescribed time before starting operations of the laundry treatment cycle. During this time interval, the user can open the door and change the amount of laundry, especially reduce the amount of laundry which is residing in the drum.

In a step 106, it is checked if the door is closed, and water is preferably loaded into the tub. A step 110 summarizes at least one, i.e. one or more, laundry treatment phase of the group: washing, rinsing, and spinning. Preferably, during at least one of these phases, detergent/additive is transported from the at least one compartment of the drawer into the tub. Preferably, water is flushed into the compartment and guided together with the detergent/additive into the tub. The laundry treatment phases of step 110 can be performed as known in the art. The described embodiment of the method allows the user to adjust the laundry load once.

At the beginning of the laundry treatment cycle, the user selects a laundry treatment program. The main selection of the program is preferably made by turning knob 38. The user interface 62 preferably comprises further user interface elements such as buttons, switches, knobs by which the user can select certain parameters of the laundry treatment program such as water temperature, spinning speed, duration.

The detection of the amount of loaded laundry results preferably in the change/adjustment of at least one parameter related to the selected laundry treatment program. These parameters which are also called operational parameters comprise parameters related to the operation of the appliance, such as drum spinning speeds and/or time, or physical parameters such as heating temperature, heating duration. This adjustment of parameters is preferably performed in all three embodiments of the method discussed in relation to FIGS. 4, 5, and 6.

Figure 5:
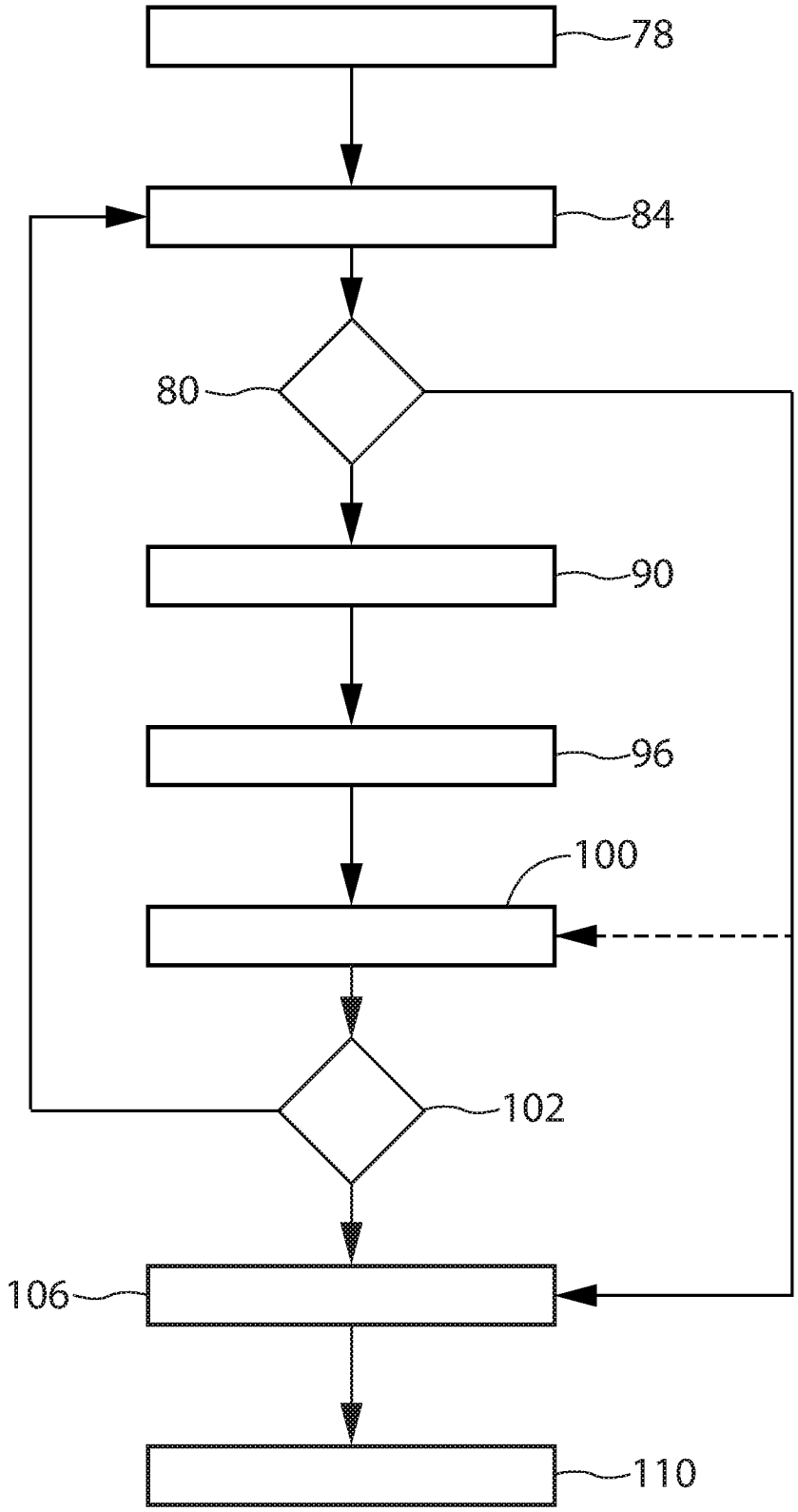
FIG. 5 shows a flow chart of a method for operating a laundry treatment appliance in a second preferred embodiment.

A method in a second preferred embodiment is shown in FIG. 5. Steps 78, 84, 90, 96, and 100 are performed as described in connection with FIG. 4. In a first step 78, laundry is loaded into the drum through opening 28. After door 24 has been closed and a user interaction with the machine has happened, preferably pressing a start button on user interface 62, in a step 84 the amount of laundry in the drum is being detected. The opening and closing of door 24 are preferably detected by a door sensor. The detection of the amount of laundry is preferably performed by rotating the drum by the motor and measuring parameters related to the motor such as current, angular velocity, motor torque. In combination or alternatively, the amount of loaded laundry can be determined by means of a weight sensor.

In a decision 80, if the detected weight falls on the laundry load threshold range, the step 100 or the step 106 below described is preferably directly performed.

In the preferred/optional step 90, it is indicated to the user, preferably on dedicated area 54 of display 50, if the detected amount of laundry/is outside a laundry load threshold range. The laundry load threshold range has an upper bound and a lower bound. By choosing the lower bound as zero, the condition is equal to the condition that a threshold value, which corresponds to the upper bound, is not exceeded. This is especially useful the appliance only checks an overload condition and not an underload condition.

This indication can be performed in a variety of ways. For instance, a red symbol can occur on area 54 if the detected laundry amount lies not within the threshold range. If the detected amount lies within the threshold range, in a first variant, no visual indication is made at all. In a second variant, a green visual indication is made which shows the user that the detected amount of laundry does not lie within the threshold range. The threshold range is preferably chosen in such a way that a laundry amount below its lower bound is not optimal and that a laundry amount exceeding its upper bound is not optimal, whereby the condition "not optimal" refers to criteria such as, for instance, the resulting treatment effectiveness or energy consumption.

In a step 96, a warning is issued, preferably on the display 50. In addition or alternatively, also an acoustic signal/alarm can be issued, which can draw the attention of the user to the appliance 2 and especially to the display 50. Preferably, the warning comprises a message that the amount of loaded laundry should be changed, which can be indicated by a symbol and/or by a text message.

In a step 100, the laundry treatment appliance waits for a prescribed time before starting operations of the laundry treatment cycle. During this time interval, the user can open the door and change the amount of laundry, especially reduce the amount of laundry which is residing in the drum.

In a decision 102, it is determined if the amount of laundry in the drum has been changed. This preferably means that an interaction occurred with the appliance which is linked to a possible access of the drum and/or a change of laundry. This user action or interaction is preferably detected by the control unit of the appliance. The interaction is preferably an opening/closing procedure of the door and/or the interaction with a dedicated button, especially a pause button. In these cases, it is considered that a laundry change has occurred.

Figure 2:
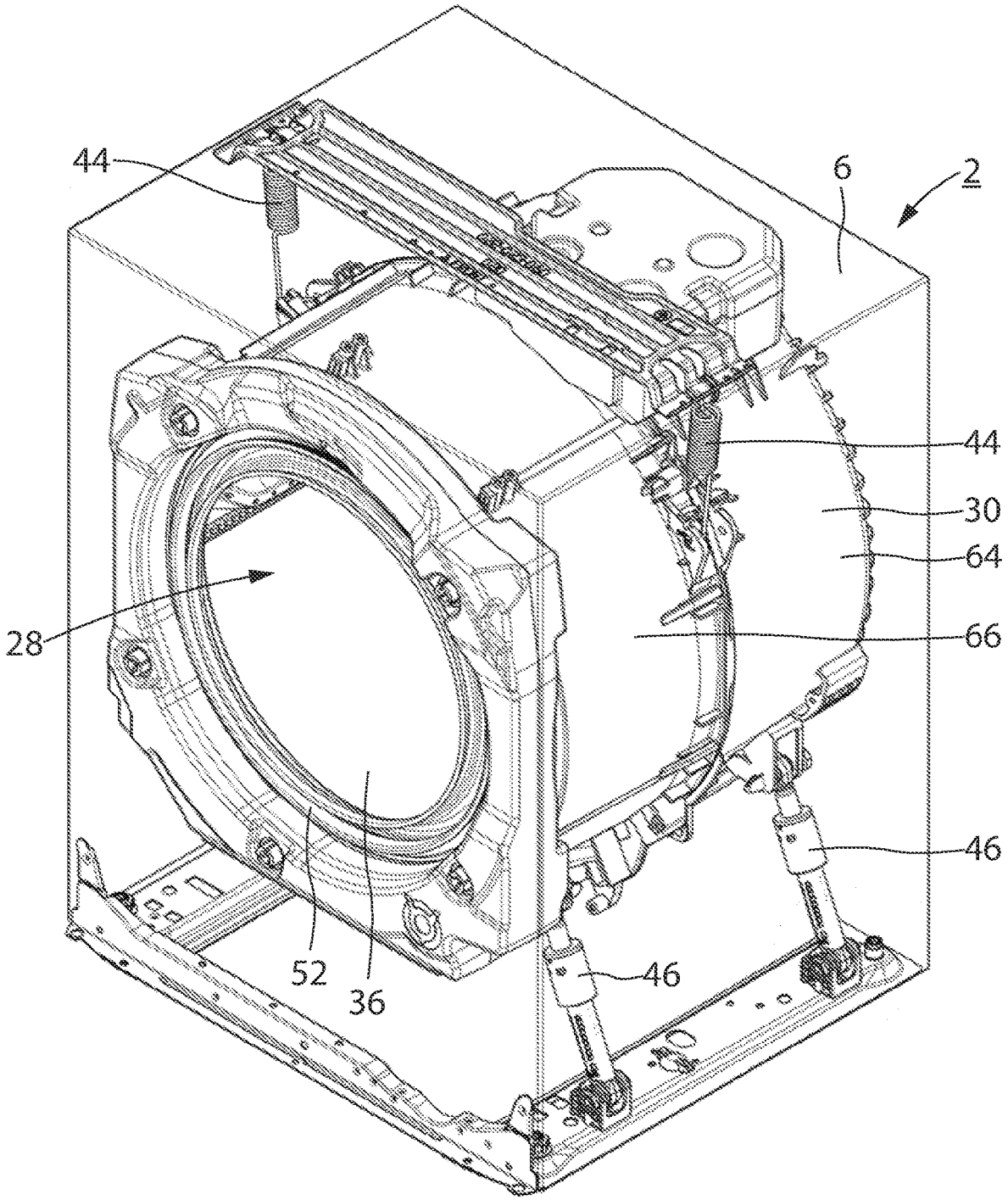
FIG. 2 shows the front loading washing machine of FIG. 1 in a frontal perspective view with the casing removed.
Figure 3:
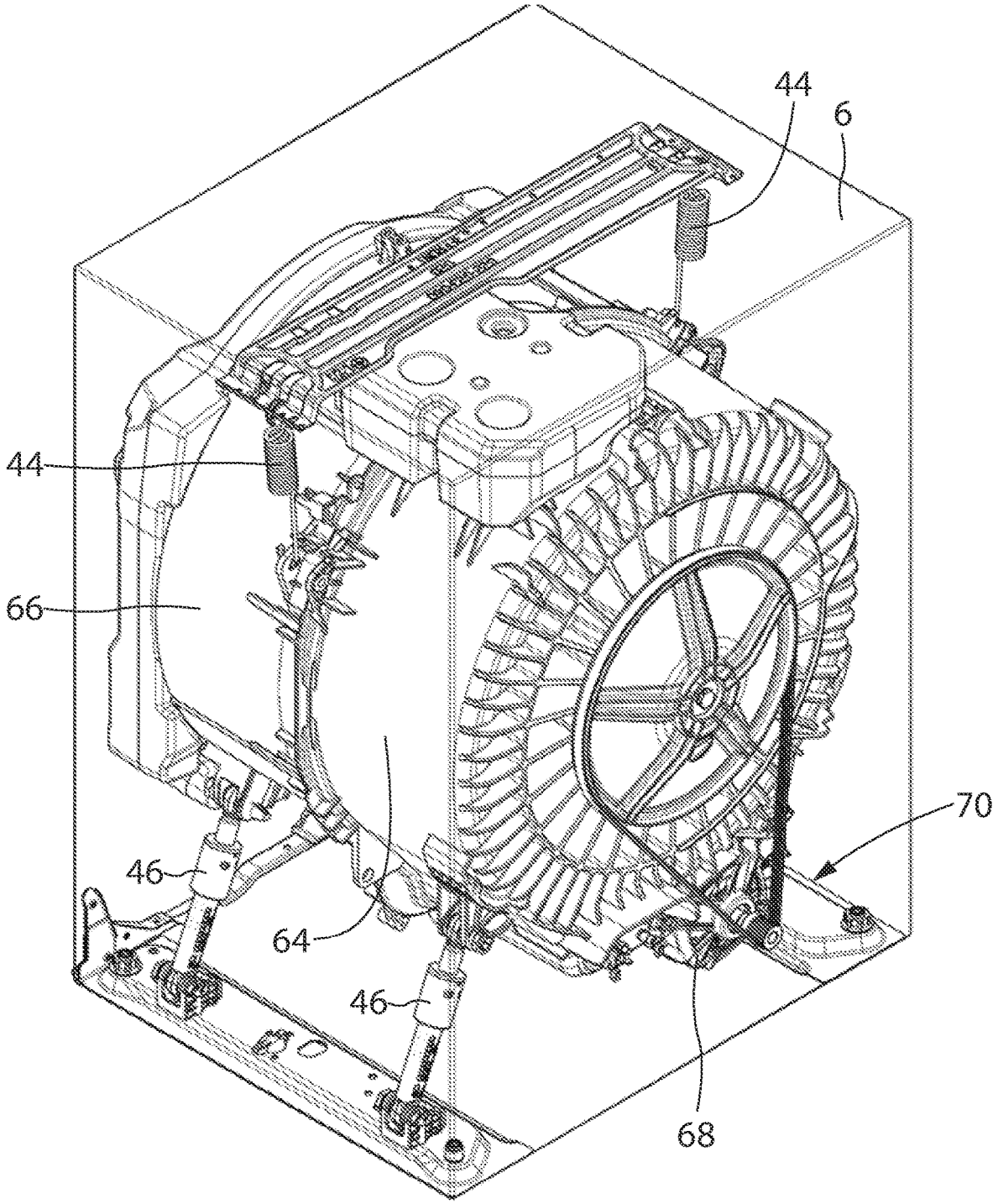
FIG. 3 shows the front loading washing machine of FIG. 1 in a perspective rear view with the casing removed.

In a first preferred variant, it is checked if during step 100, the door 24 has been opened and closed again, which is an indication that the amount of laundry in the drum has changed. If these opening/closing actions have not been detected, the method branches to step 106, after which step 110 is performed. Steps 106 and 110 are performed as described in connection with FIG. 2. If the door has been opened and closed and/or if the user has actuated a dedicated button such as a pause button, the method branches to step 84 and performs again the determination of the amount of laundry in the drum.

Figure 6:
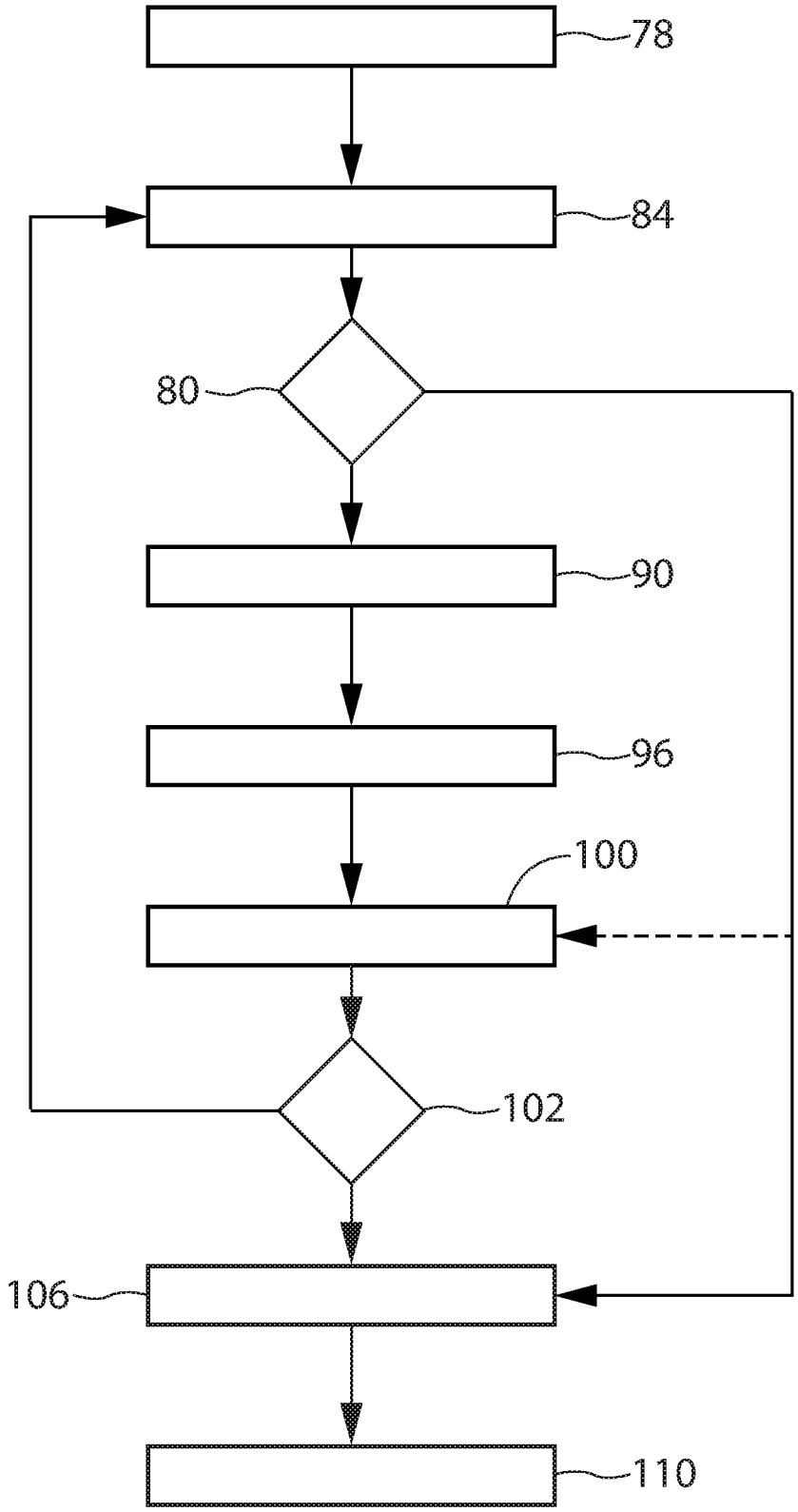
FIG. 6 shows a flow chart of a method for operating a laundry treatment appliance in a third preferred embodiment.

A method in a further preferred embodiment is shown in FIG. 6 in a flow chart. This method is performed in the control unit of a laundry treatment appliance which is built as a combined washer/dryer or a dryer and in which a laundry treatment program is selected which is designed as a combined washing and drying routine or a drying routine in the case of a dryer.

In a first step 78, laundry is loaded into the drum through opening 28. After door 24 has been closed and a user interaction with the machine has happened, preferably pressing a start button on user interface 62, in a step 84 the amount of laundry in the drum is being detected/determined. The opening and closing of door 24 are preferably detected by a door sensor. The detection of the amount of laundry is preferably performed by rotating the drum by the motor and measuring parameters related to the motor such as current, angular velocity, motor torque.

In a decision 80, if the detected weight falls on the laundry load threshold range, the step 100 or the step 106 below described is preferably directly performed.

In the preferred/optional step 90, it is indicated to the user, preferably on dedicated area 54 of display 50, if the detected amount of laundry exceeds a specified laundry amount threshold. This indication can be performed in a variety of ways. For instance, a red symbol can occur on area 54 if the threshold is exceeded. If the threshold value is not exceeded, in a first variant, no visual indication is made at all. In a second variant, a green visual indication is made which shows the user that the loaded amount of laundry is not exceeding a threshold value.

The upper bound of the laundry load threshold range in the present embodiment is chosen as the maximum amount of laundry which can be dried in the selected washing/drying routine. The laundry amount threshold for a drying routine is typically smaller than a laundry amount threshold for a washing process as discussed above.

In a step 96, a warning is issued, preferably on said display 50, to the user as described in connection with the previous embodiments. In addition, also an acoustic signal/alarm can be issued, which can draw the attention of the user to the appliance 2 and especially to the display 50.

In a step 100, the laundry treatment appliance waits for a prescribed time before continuing operations of the laundry treatment cycle. During this time interval, the user can open the door and change the amount of laundry, especially reduce the amount of laundry which is residing in the drum.

In a decision 102, it is determined if the amount of laundry in the drum has been changed. This preferably means that an interaction occurred with the appliance which is linked to a possible access of the drum and/or a change of laundry. This user action or interaction is preferably detected by the control unit of the appliance. The interaction is preferably an opening/closing procedure of the door and/or the interaction with a dedicated button, especially a pause button. In these cases, it is considered that a laundry change has occurred.

In a first preferred variant, it is checked if during step 100, the door 24 has been opened and closed again, which is an indication that the amount of laundry in the drum has changed. If these opening/closing actions have not been detected, the method branches to step 106, after which step 110 is performed. Steps 106 and 110 are performed as described in connection with FIG. 2. If the door has been opened and closed and/or if the user has pressed a button, especially a pause button, which suspends or pauses and or continue the laundry treatment process, the method branches to step 84 and performs again the determination of the amount of laundry in the drum.

In a step 106, water is loaded into the tub if the appliance is a combined washer/dryer. A step 110 summarizes at least one, i.e. one or more, laundry treatment phase of the group: washing, rinsing, and spinning. Preferably, in a combined washing and drying process, during at least one of these phases, detergent/additive is transported from the at least one compartment of the drawer into the tub. Preferably, water is flushed into the compartment and guided together with the detergent/additive in the tub. The laundry treatment phases of step 110 can be performed as known in the art.

The invention thus conceived can be subjected to numerous modifications and variants all falling within the scope of the inventive concept. In addition, all details can be replaced by other technically equivalent elements. In practice, all the materials used, as well as the shapes and contingent dimensions, may vary depending on the requirements without departing from the scope of protection of the following claims.

The invention claimed is:

1. A method for operating a laundry treatment appliance, comprising a casing within which a drum rotated by a motor is arranged, an opening provided in the casing for loading the laundry into the drum and a door adapted to selectively open and close the opening, the method comprising performing a laundry treatment cycle comprising:

a) determining the amount of laundry load in the drum;

b) if the determined amount of laundry is outside a laundry load threshold range, issuing a warning to the user and waiting for a prescribed waiting time before starting the cycle; and during the prescribed waiting time, switching the laundry treatment appliance to an operating mode in which the user to is allowed to change the amount of laundry load in the drum, wherein a changing of the amount of laundry loaded into the drum by the user is detected by the opening and the closure of the door during the waiting time.

2. The method according to claim 1, further comprising:

c) determining if the amount of loaded laundry has been changed after the warning has been issued;

d) upon determining that the amount of laundry load in the drum has not changed, starting the at least one laundry treatment cycle; and e) upon determining that the amount of laundry load has changed, re-performing steps a) to e).

3. The method according to claim 1, wherein the treatment cycle further comprises the step of indicating if and/or how much the amount of laundry load lies outside the laundry load threshold range.

4. The method according to claim 1, wherein the warning comprises an acoustic signal and/or message.

5. The method according to claim 1, wherein the laundry treatment appliance comprises a display, and the warning comprises displaying an indication on the display.

6. The method according to claim 1, wherein the prescribed waiting time is between 10 and 120 seconds.

7. The method according to claim 1, wherein the prescribed waiting time is 30 seconds.

8. The method according to claim 1, wherein the appliance comprises a tub, and step a) is performed without and/or before supplying water to the tub.

9. The method according to claim 1, wherein in step a) the laundry load amount is determined by rotating the drum and measuring parameters related to the motor.

10. The method according to claim 1, further comprising selecting the laundry load threshold range based on a selected washing program of the appliance and/or on the kind of laundry.

11. The method according to claim 1, wherein the laundry treatment appliance is a combined washer/dryer, and wherein the laundry treatment cycle is a combined washing and drying cycle, and wherein an upper bound of the laundry load threshold range of step b) is a threshold value based on the maximum laundry load that can be dried in the combined washing and drying cycle.

12. The method according to claim 11, wherein in the combined washing and drying cycle, the drying operations are performed after all washing operations.

13. A laundry treatment appliance, comprising:

a casing;

a rotatable drum inside the casing;

a motor configured to rotate the rotatable drum an opening provided in the casing for loading laundry into the drum;

a door adapted to selectively open and close the opening;

and a control unit configured to operate the laundry treatment appliance by:

a) determining the amount of a laundry load in the drum;

b) if the determined amount of laundry is outside a laundry load threshold range, issuing a warning to the user and waiting for a prescribed waiting time before starting the cycle; and during the prescribed waiting time, switching the laundry treatment appliance to an operating mode in which the user to is allowed to change the amount of laundry load in the drum, wherein a changing of the amount of laundry loaded into the drum by the user is detected by the opening and the closure of the door during the waiting time.

14. The laundry treatment appliance according to claim 13, wherein the laundry treatment appliance is configured as a front-loading washing machine or a combined washer/dryer.

15. The laundry treatment appliance according to claim 13, wherein the control unit is further configured to operate the laundry treatment appliance by:

c) determining if the amount of loaded laundry has been changed after the warning has been issued;

d) upon determining that the amount of laundry load in the drum has not changed, starting the at least one laundry treatment cycle; and e) upon determining that the amount of laundry load has changed, re-performing steps a) to e).

* * * * *